US005786060A

United States Patent [19]

Takahashi et al.

[11] Patent Number: 5,786,060

[45] Date of Patent: Jul. 28, 1998

[54] FEMALE MEMBER FOR FACE FASTENER AND METHOD OF PRODUCING THE SAME

[75] Inventors: Keisuke Takahashi; Hideo Kimura, both of Souwa-machi, Japan

[73] Assignee: Japan Vilene Company, Ltd., Tokyo, Japan

[21] Appl. No.: 535,335

[22] Filed: Sep. 28, 1995

[51] Int. Cl.[6] ..... B32B 3/02

[52] U.S. Cl. ..... 428/89; 428/97; 428/219; 428/92; 428/95

[58] Field of Search ..... 428/89, 92, 96, 428/95, 97, 219

[56] References Cited

U.S. PATENT DOCUMENTS

| | | | |
|---|---|---|---|
| 4,379,189 | 4/1983 | Platt | 428/89 |
| 5,326,612 | 7/1994 | Goulait | 428/100 |

FOREIGN PATENT DOCUMENTS

| | | |
|---|---|---|
| 0 054 870 A1 | 6/1982 | European Pat. Off. . |
| 0 171 807 A2 | 2/1986 | European Pat. Off. . |
| 2 118 484 | 11/1983 | United Kingdom . |
| WO 92/01401 | 2/1992 | WIPO . |
| Wo 92/20250 | 11/1992 | WIPO . |

*Primary Examiner*—Christopher Raimund
*Attorney, Agent, or Firm*—Oliff & Berridge, PLC

[57] ABSTRACT

The invention provides a female member for a face fastener. The female member has loops formed on a first surface of a web. The web has a heat-melt-adhering composite fiber body and is densely heat-melt-adhered together on a second surface. A female member is also provided having ridge-like webs. A method of producing the female member is also provided. A web of a heat-melt-adhering composite fiber body is entangled to form loops on the first surface of the web. After advanced heat-treatment, the second surface is heat-melt-adhered. A method of producing the female member by needling or water stream treating the web is also provided. An inexpensive female member for a fastener is produced suitable for disposable goods such as diapers, hospital clothings, underwears and the like.

10 Claims, 4 Drawing Sheets

FEMALE MEMBER FOR FACE FASTENER AND METHOD OF PRODUCING THE SAME

BACKGROUND OF THE INVENTION

1. Field of the Invention

The invention relates to a female member for a face fastener that is inexpensive and suitable for disposable applications.

2. Description of Related Art

Face fasteners are used as an engaging fitting. A female member of a face fastener has loop female elements on a surface of a knitted or woven fabric. A male member of the face fastener has hook or mushroom male elements formed on a surface of another knitted or woven fabric. The female member and the male member are attached to face portions of a fabric. The face portions of the fabric are fastened together by forcibly engaging the female and male members. The face portions of the fabric are unfastened or disengaged by peeling the female and male members apart.

The female loop elements comprise either multifilament or monofilament fibers made from synthetic resins such as nylon or polyester. The male booked mushroom shaped elements have monofilament swollen heads made from materials such as nylon, polyester, polyethylene or polypropylene. The female and male members of the face fastener can be repetitively engaged and disengaged for many times. Thus, face fasteners are suited for applications that require durability.

However, for disposable articles, the face fasteners are used only about 5 to 10 times and then discarded. Thus, for disposable applications, surface fasteners need not have the durability to withstand a large number of engagement-disengagement cycles.

Furthermore, conventional female members for face fasteners are formed on knitted or woven fabric surfaces. The knitted or woven fabric yarns are loosened during use causing the female member to lose dimensional stability. Also, the female member becomes curled and difficult to use.

SUMMARY OF THE INVENTION

An object of the invention is to provide a female member for a face fastener. The female member has loops formed on a first surface of a web having a heat-melt-adhering composite fiber body. A second surface of the web is densely heat-melt-adhered together. The invention also provides a female member for a face fastener in which the web is formed like ridges.

Another object of the invention is to provide a method of producing the female member by entangling the heat-melt-adhering composite fiber body of the web to form loops on the first surface of the web, and, after heat-treated in advance, the second surface is heat-melt-adhered. The invention further provides a method of producing a female member by needling or by water stream treatment.

Another object of the invention is to provide a female member of a face fastener which is thin, soft and easy to use.

Another object of the invention is to provide a female member used for disposable purposes, i.e., for hospital clothing and for clothes such as diapers, underwears, and the like.

BRIEF DESCRIPTION OF THE DRAWINGS

The invention is described in detail with reference to the following drawings, wherein.

DETAILED DESCRIPTION OF PREFERRED EMBODIMENTS

Figure 1:
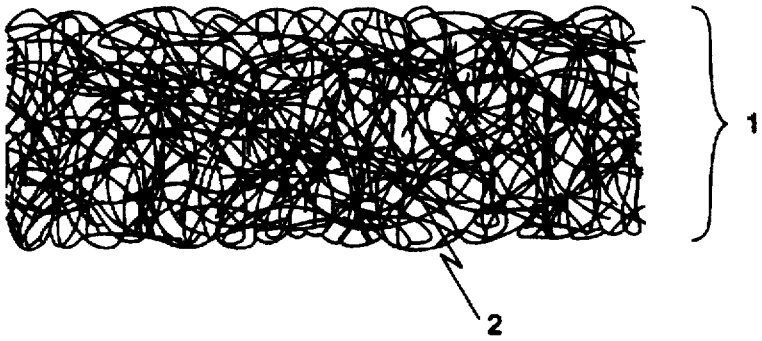
FIG. 1 is a cross-sectional view of a web.

FIG. 1 shows a web 1 of a female member. The web 1 is made of heat-melt-adhering composite fibers having loops 3. The heat-melt-adhering composite fibers may be mixed with other fibers to enhance a strength of engagement of the female and male members. The fibers 2 have a fineness of about 0.5 to 10 deniers and, preferably, about 1 to 6 deniers. When the fineness is less than 0.5 deniers, the loops 3 are distorted and often fail to engage with the male member.

As for the strength of the fibers 2, a tensile strength is greater than about 2 g/denier. When the tensile strength is less than 2 g/denier, the loops 3 are cut when the male member is engaged with the surface of the female member and loops 3 are pulled away. Therefore, the strength of engagement of the female and male members decreases after the fastener is engaged-disengaged repetitively.

The heat-melt-adhering composite fibers may be composite fiber types such as core-sheath, bonded, separation, polyolefin, polyester or polyamide. The core-sheath composite fiber of the eccentric and concentric types are made of polypropylene and polyethylene.

The web 1 of the heat-melt-adhering composite fiber body may be mixed with other fibers; may be a single layer or of a plurality of layers having different compositions and fineness; or may be overlapped on other base fabric materials such as woven fabric, nonwoven fabric, knitted fabric or mesh.

Figure 2:
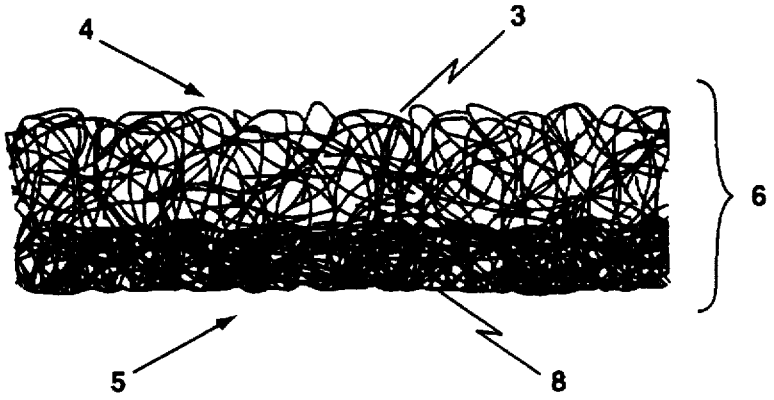
FIG. 2 is a cross-sectional view of a female member.

FIG. 2 shows a female member 6 having a first surface 4 and a second surface 5. The first surface 4 has loops 3 and the second surface 5 is heat-melt-adhered into a heat-melt-adhered layer 8.

The loops 3 have a shape of substantially a loop on the surface of the webs formed by needle punching or water stream treatment. The shapes of the loops 3 include low loop, loose loop, bundle-like loop or piled loop which are entangled. The web 1 can also be laminated on a base fabric by entangling them with the second surface 5 of the web 1 by needle punching or water stream treatment.

Figure 3:
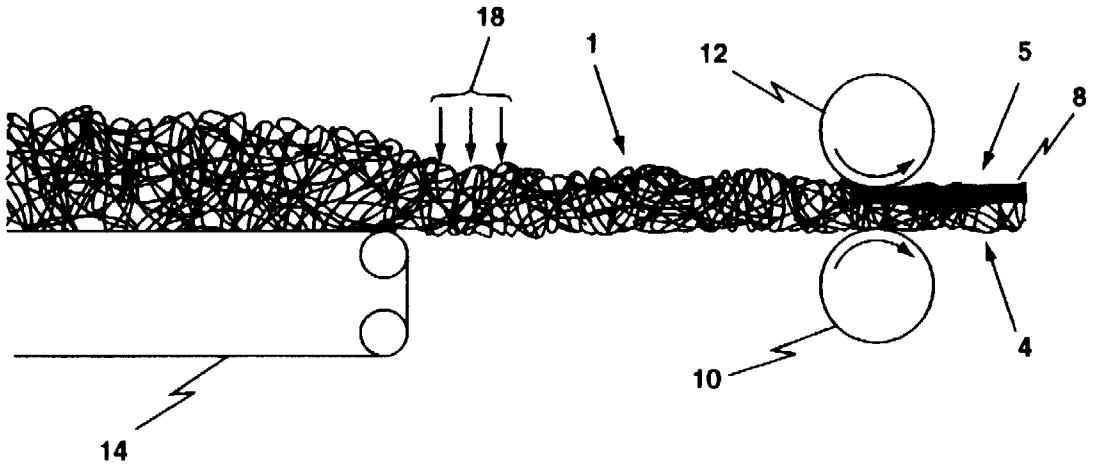
FIG. 3 is a diagram of a process for forming female members using needle punching.

FIG. 3 shows loops 3 formed by needle punching 18. The needle density is about 20 to 300 needles/cm$^2$ and, preferably, about 40 to 150 needles/cm$^2$. The depth of needle punching is about 5 to 20 mm and, preferably, about 8 to 15 mm.

Figure 4:
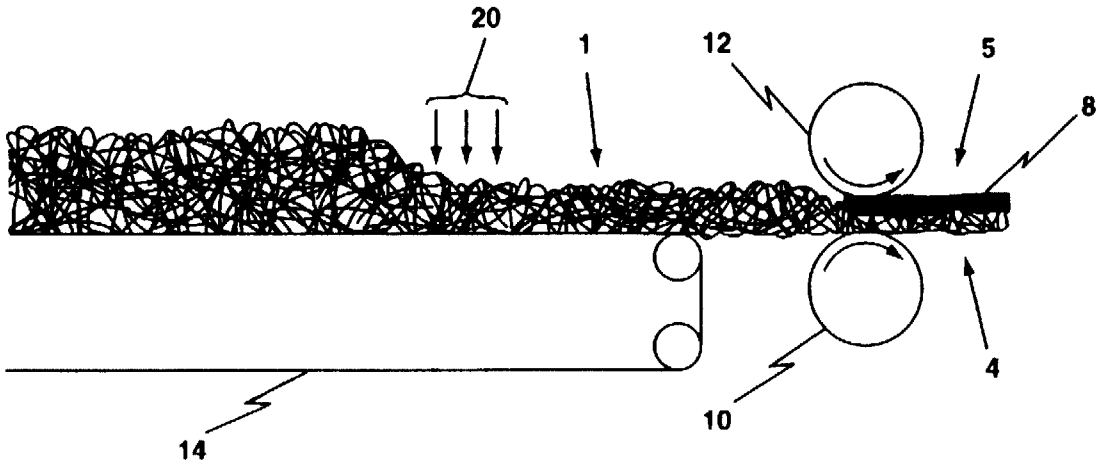
FIG. 4 is a diagram of a process for forming female members having loops using a water stream treatment.

FIG. 4 shows loops 3 formed by a water stream treatment using a water stream 20. The nozzle plate has a nozzle diameter of about 0.05 to 0.3 mm and, preferably, about 0.08 to 0.2 mm. The nozzles have a pitch of about 0.2 to 10 mm and, preferably, about 0.4 to 10 mm. The pressure of the water stream 20 is about 10 to 300 kgf/cm$^2$ and, preferably, about 50 to 200 kgf/cm$^2$. The water stream is applied one or more times from at least one surface of the web 1.

A conveyer net 14 for treating the web 1 with the water stream 20 has a size of about 15 to 120 mesh from the standpoint of perforating the web 1 and enhancing the strength of engagement of the female and male members. Preferably, the conveyer net 14 should have a size of about 20 to 100 mesh.

Figure 5:
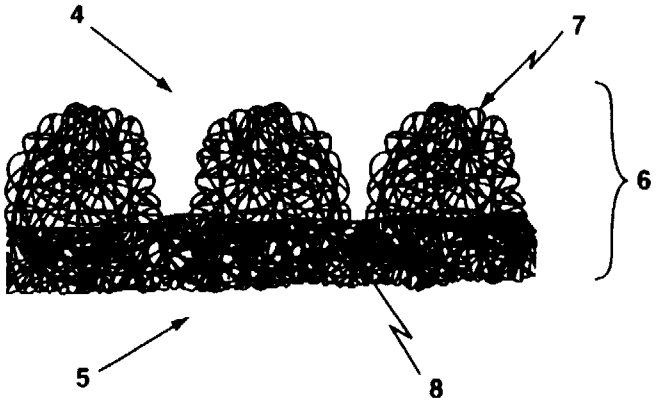
FIG. 5 is a cross-sectional view of a female member having ridges.

FIG. 5 shows a ridge-like web formed by using the water stream treatment. The strength of engagement of the female and male members is enhanced even by the sides of the ridges 7. The shear strength is also increased in a direction in parallel with the ridges 7.

Figure 7:
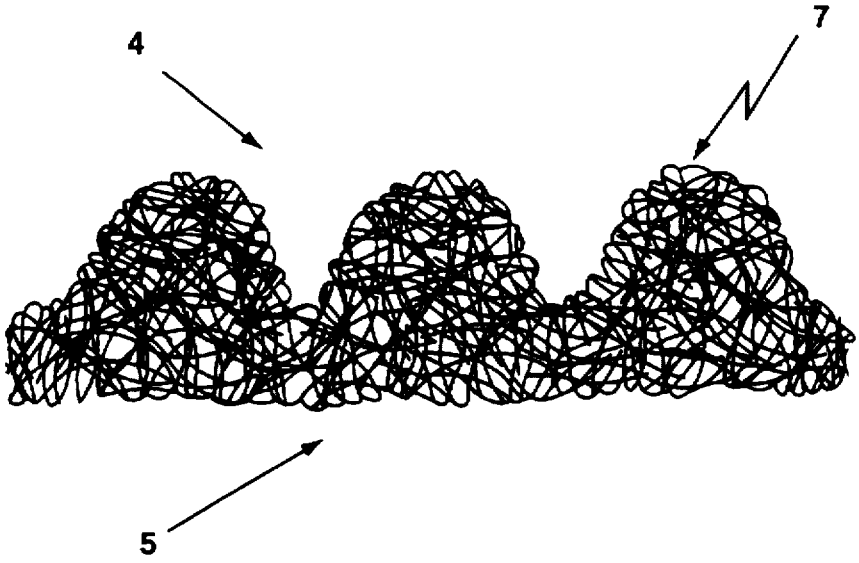
FIG. 7 is a diagram of forming ridges using a water stream.

The ridge-like web is formed using a nozzle pitch of about 0.8 to 10 mm a shown in FIG. 7. When the nozzle pitch-is less than about 0.8 mm, ridge-like web is not formed. When the nozzle pitch exceeds about 10 mm, the strength of the female-male engagement decreases. Therefore, the nozzle pitch preferably has a range of about 1 to 5 mm.

Figure 6:
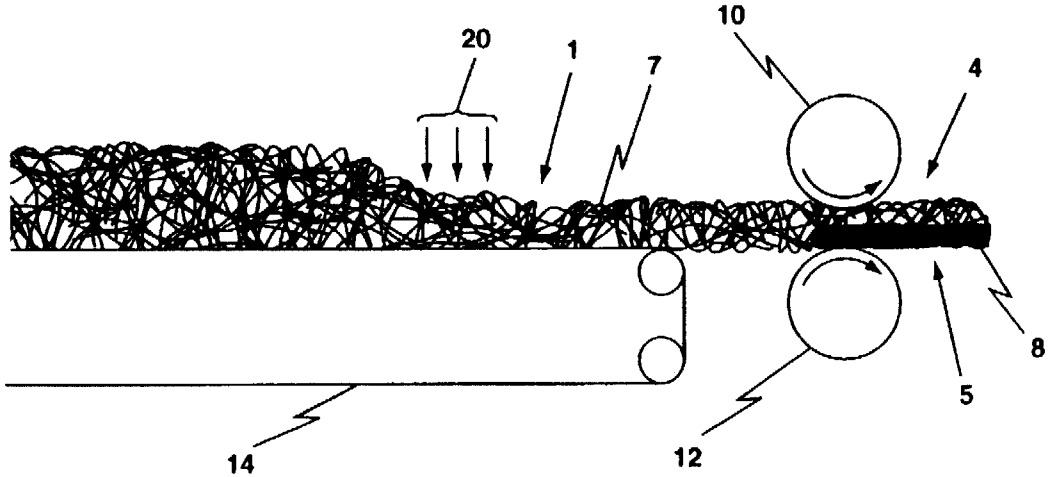
FIG. 6 is a diagram of a process for forming female members having ridges using the water stream treatments.

When the ridge-like web is formed on the first surface 4, the web 1 of the second surface 5 must be heat-melt-adhered, as shown in FIG. 6. The second surface 5 is nearest to the conveyer net 14. Under this process, the shear strength of the female members is measured by being pulled in a direction in parallel with the ridges 7.

The needle punching needles are preferred to be crown-barbed needles having a triangular or a substantially square shaped blade cross-section and three to four barbs arranged equal distant from the tip of the blade. Fork needles are preferred to form bundle-like loops which produce an increased strength of female-male engagement.

Web 1, having loops 3 formed on the first surface 4, are densely heat-melt-adhered on the second surface 5 by passing each web 1 through a pair of rollers 10 and 12 provided with a space, as shown in FIGS. 3, 4 and 6. The temperature of a first roller 12 of the pair of rollers 10 and 12 is higher than the temperature of a second roller 10 of the pair of rollers 10 and 12. The temperature of the first roller 12 is about 120° C. to 150° C. and the temperature of the second roller 10 is less than about 80° C.

The first surface 4 of the web 1 contacts the lower temperature roller 10 and the second surface 5 of the web 1 contacts the higher temperature roller 12. The web 1 also may be densely heat-melt-adhered by contacting the second surface 5 with a drum heated at a high temperature, heat-treating the second surface 5 in advance with high temperature hot air or radiating the second surface 5 with infrared rays. After treating the second surface 5 with heat, the web 1 is passed through a pair of cooling rollers also having a space. The cooling rollers are maintained at a temperature less than about 80° C.

Without the space, the web 1 is heat-melt-adhered on both the first and second surface 4 and 5, respectively. The space is about 0.3 mm between the rollers.

The female member 6 has a weight of about 20 to 100 g/m$^2$ and, preferably, about 30 to 100 g/m$^2$. The female member 6 has a thickness of about 0.2 to 1.5 mm and, preferably, about 0.5 to 1.0 mm.

Even when the web 1 has many loops 3, the loops 3 are not loosened at portions that are cut when compared with conventional knitted fabrics. In addition, the webs exhibit good dimensional stability and can be easily handled during stitching.

The female member 6 for the face fastener of the invention prevents the loops 3 from being removed from the web 1, increases the strength of engagement of the female and male members, exhibits good dimensional stability, and further, can be formed into a tape. Moveover, the second surface 5 of the web 1 forms a smooth film that reduces the female member's thickness.

Because the female member 6 is densely heat-melt-adhered on the second surface 5, the female member 6 is almost a film. Thus, for fabrics such as diapers, hospital clothings and the like, the female member 6 exhibits good heat-sealing properties.

Further, the female member 6 has good dimensional stability and is soft compared with conventional female members having the structure of a knitted fabric. Conventional female members cause discomfort when applied to diapers and the like because the female members occupy large areas. In addition, the female member 6 of the invention is easy to handle, can be produced at a low cost and is suitable for disposable goods such as diapers, hospital clothings, packaging materials and the like.

The invention will be further described below by examples showing tested strength of engagement of the female and male members. The peel strength and the shear strength representing the strengths of engagement of the female and male members are tested in compliance with a method of testing the face fastener stipulated under JIS L3416.

Peel strength is measured using a mushroom tape male member engaged with a test piece female member. A cylindrical roller having a smooth surface capable of applying a pressure of about 1 kgf per 1 cm of an effective width of the fastener is used to engage the female and male members together. Test pieces of a 25 mm wide male member and a 25 mm wide female member are overlapped over a length of 3 cm having an end of each of the female and male members oriented in the same direction. The male and female members are engaged together by moving the roller over the female-male members. Then, the test pieces are peeled off at a pulling rate of 20 cm/min by a tensile tester.

Six maximum and six minimum values of test results for each test piece are averaged to determine the peeling strength (gf/cm) per unit width. The test results of five test pieces are averaged to determine the final test results.

Shear strength is measured using test pieces of a 25 mm wide male member a 25 mm wide female member overlapped over a length of 3 cm and having a free end of the female member and a free end of the male member oriented in opposing directions. The male and female members are engaged together by moving the roller over the female and male members. The test pieces are pulled using the opposing free ends at a pulling rate of 20 cm/min by the tensile tester.

A maximum shear stength value of the test piece is measured. An average value of five test pieces is used as a shear strength (kgf/cm$^2$) per unit area.

EXAMPLE 1

The web comprises a heat-melt-adhering core-sheath composite fiber. The core is polypropylene and the sheath is polyethylene. The core-sheath, identified as ES033, is produced by Chisso Co. The fiber has a fineness of 3 denier and a length of 64 mm. The web is needle-punched using a crown-barbed needle having a needle density of 50 needles/cm$^2$ and a needle punching depth of 13 mm. A punched felt is produced having a weight of 46 g/m$^2$ and having loops formed on a first surface of the web.

The punched felt is passed through between the high-temperature roller 12 heated at 150° C. and the low-temperature roller 10 heated at 80° C. The space between the rollers is 0.3 mm. The first surface 4 of the web 1 is rolled by the low temperature roller 10. The second surface 5 is rolled by the high-temperature roller 12 so that the second surface 5 is densely heat-melt-adhered.

The produced female member 6 has a weight of 46.2 g/m$^2$, a thickness of 0.62 mm, a peeling strength of 38.6 gf/cm, and a shear strength of 0.28 kgf/cm$^2$.

EXAMPLE 2

The punched felt of Example 1 is heat-treated at 140° C. for one minute using a hot air circulation dryer. The heated punched felt is passed between the high-temperature roller 12 and low-temperature roller 10. The second surface 5 is densely heat-melt-adhered as in Example 1.

The produced female member 6 has a weight of 50.6 g/m$^2$, a thickness of 0.65 mm, a peeling strength of 22.8 gf/cm and a shear strength of 0.44 kgf/cm$^2$.

EXAMPLE 3

The web comprises a heat-melt-adhering core-sheath composite fiber and a polypropylene fiber at mixing a weight ratio of 65% to 35%. The core is polypropylene and the sheath is polyethylene. The core-sheath, identified as ES033, is prduced by Chisso Co. The composite fiber has a fineness of 3 denier and a length of 64 mm.

The polypropylene fiber has a fineness of 2 denier and a length of 51 mm. The web is needle-punched using a crown-barbed needle having a needle density of 50 needles/cm$^2$ and a needle depth of 13 mm. A punched felt is produced having loops 3 formed on the first surface 4.

The punched felt is then passed between a high-temperature roller 12 and a low-temperature roller 10. The second surface 5 is densely heat-melt-adhered as in Example 1.

The produced female member 6 has a weight of 52.8 g/m$^2$, a thickness of 0.96 mm, a peeling strength of 49.7 gf/cm and a shear stfength of 0.34 kgf/cm.

EXAMPLE 4

A web 1 comprises a heat-melt-adhered core-sheath composite fiber. The core is polypropylene and the sheath is polyethylene. The core-sheath, identified as ES033, is produced by Chisso Co. The web 1 has fineness of 3 denier and a length of 64 mm and is placed on a netconveyer of 100 mesh and is entangled with a water stream treatment having a pressure of 50 kgf/cm$^2$, nozzle diameter of 0.13 mm, and nozzle pitch of 0.6 mm. A nonwoven fabric entangled with the water stream is produced.

The nonwoven fabric is passed between a high-temperature roller 12 heated at 150° C. and a low-temperature roller 10 heated at 50° C. The space between rollers 10 and 12 is 0.3 mm. The second surface that does not have the loops 3 contacts the high-temperature roller 12 so that the surface is densely heat-melt-adhered.

The produced female member has a weight of 40.6 g/m$^2$, a thickness of 0.62 mm, a peeling strength of 11.1 gf/cm, and a shear strength of 0.16 kgf/cm$^2$.

EXAMPLE 5

A web 1 comprises a heat-melt-adhering core-sheath composite fiber. The core is polypropylene and the sheath is polyethylene. The core-sheath, identified as ES033, is produced by Chisso Co. The web 1 has a fineness of 3 denier and a length of 64 mm and is placed on a net conveyer of 50 mesh. The web 1 is entangled using the water stream treatment having a pressure of 50 kgf/cm$^2$, a nozzle diameter of 0.18 mm, and a nozzle pitch of 1.2 mm.

A ridge-like nonwoven fabric entangled by the water stream is produced.

The nonwoven fabric is passed between a high-temperature roller 12 heated at 150° C. and a low-temperature roller 10 heated at 50° C. The space between rollers 10 and 12 is 0.3 mm. The second surface that does not have the ridge 7 contacts the high-temperature roller 12 so that the surface is densely heat-melt-adhered. The produced female member has a weight of 46.7 g/m$^2$, a thickness of 0.78 mm, a peel strength of 11.5 gf/cm, a shear strength of 0.30 kgf/cm$^2$ in a direction in parallel with the ridges and a shear strength of 0.19 kgf/cm$^2$ in a direction at right angles with the ridges.

COMPARATIVE EXAMPLE 1

A punched felt having the same weight and the same thickness as Example 1 is prepared by using a polypropylene fiber instead of using the heat-melt-adhering composite fiber of Example 1. The polypropylene fiber is heat-melt-adhered by passing the punched felt between a high-temperature roller heated to 160° C. and a low-temperature roller heated to 50° C. The space between rollers is 0.3 mm. The polypropylene fiber shrinks and the loops become dense. The polypropylene fiber is so hard that the produced female member is almost unusable.

COMPARATIVE EXAMPLE 2

A polyethylene film is placed over a punched felt having loops formed on a first surface. The punched felt is prepared as in Example 2. The polyethylene film is placed over a second surface without the loops and is heat-melt-adhered at 120° C.

The produced female member has a weight of 79.6 g/m$^2$, a thickness of 0.54 mm, a peeling strength of 13.0 gf/cm and a shear strength of 0.34 kgf/cm$^2$. The female member exhibited no gas permeability.

While this invention has been described in conjunction with specific embodiments therof, it is evident that many alternatives, modification and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A female member for a face fastener, comprising:

a web which includes a heat-melt-adhering composite fiber body;

a plurality of entangled loops formed in a first surface of the web; and a densified heat-melt-adhered layer formed in a second surface of the web, wherein the web includes fibers having a fineness of about 0.5 to 10 deniers and a tensile strength of greater than about 2 g/denier and the second surface is more dense than the first surface so that the plurality of entangled loops formed in the first surface can be forcibly engaged with elements formed on a surface of a male member, with a peel strength required to separate the plurality of entangled loops from the elements formed on the surface of the male member being at least 20 gf/cm.

2. The female member of claim 1, wherein the plurality of entangled loops are formed by one of needle punching using a crown-barbed needle and a water stream treatment.

3. The female member of claim 1, wherein the heat-melt-adhering composite fiber body comprises a core-sheath composite fiber.

4. The female member of claim 1, wherein the heat-melt-adhering composite fiber body comprises at least one of polypropylene and polyethylene.

5. The female member of claim 1, wherein the female member has a weight of about 20 to 200 g/m$^2$.

6. A female member for a face fastener, comprising:

a web which includes a heat-melt-adhering composite fiber body;

a plurality of entangled loops formed in a first surface of the web;

a plurality of ridges formed on the first surface of the web; and a densified heat-melt-adhered layer formed in a second surface of the web, wherein the web includes fibers having a fineness of about 0.5 to 10 deniers and a tensile strength of greater than 2 g/denier and the second surface is denser than the first surface so that the plurality of entangled loops formed in the first surface can be forcibly engaged with elements formed on a surface of a male member, with a peel strength required to separate the plurality of entangled loops from the elements formed on the surface of the male member being at least 20 gf/cm.

7. The female member of claim 6, wherein the plurality of ridges are formed by a water stream treatment.

8. The female member of claim 6, wherein the heat-melt-adhering composits fiber body is a core-sheath composite fiber.

9. The female member of claim 6, wherein the heat-melt-adhering composite fiber body comprises at least one of polypropylene and polyethylene.

10. The female member of claim 6, wherein the female member has a weight of about 20 to 200 g/m$^2$.

* * * * *